US011975373B2

(12) United States Patent
Noh

(10) Patent No.: US 11,975,373 B2
(45) Date of Patent: May 7, 2024

(54) ELBOW-SHAPED DUCT MANUFACTURING APPARATUS

(71) Applicant: Sung Keun Noh, Suwon-si (KR)

(72) Inventor: Sung Keun Noh, Suwon-si (KR)

( * ) Notice: Subject to any disclaimer, the term of this patent is extended or adjusted under 35 U.S.C. 154(b) by 19 days.

(21) Appl. No.: 17/276,573

(22) PCT Filed: Sep. 1, 2020

(86) PCT No.: PCT/KR2020/011678
§ 371 (c)(1),
(2) Date: Mar. 16, 2021

(87) PCT Pub. No.: WO2021/045471
PCT Pub. Date: Mar. 11, 2021

(65) Prior Publication Data

US 2022/0184681 A1 Jun. 16, 2022

(30) Foreign Application Priority Data

Sep. 5, 2019 (KR) ..... 10-2019-0110096

(51) Int. Cl.
*B21C 37/12* (2006.01)

(52) U.S. Cl.
CPC ..... *B21C 37/125* (2013.01); *B21C 37/121* (2013.01); *B21C 37/128* (2013.01)

(58) Field of Classification Search
CPC ... B21C 37/125; B21C 37/121; B21C 37/128; F24F 13/0245; B21D 7/00; B21D 11/08; B21D 19/046; B21D 39/02; B23P 23/04
See application file for complete search history.

(56) References Cited

U.S. PATENT DOCUMENTS

| | | | | |
|---|---|---|---|---|
| 5,014,424 | A * | 5/1991 | Takasugi | B21C 37/125 72/50 |
| 6,363,764 | B1 | 4/2002 | Bota et al. | |
| 6,378,184 | B1 * | 4/2002 | Bota | B21C 37/124 72/71 |
| 7,797,805 | B2 * | 9/2010 | Rieck | B21C 37/28 72/71 |
| 9,561,536 | B2 * | 2/2017 | Bota | B21D 51/04 |
| 10,493,511 | B2 * | 12/2019 | Noh | B21D 11/06 |
| 2005/0028337 | A1 | 2/2005 | Bota | |
| 2007/0251285 | A1 | 11/2007 | Cha et al. | |
| 2016/0114368 | A1 * | 4/2016 | Rieck | B25J 11/00 29/890.149 |
| 2022/0184681 | A1 * | 6/2022 | Noh | B21D 39/02 |

FOREIGN PATENT DOCUMENTS

| | | |
|---|---|---|
| EP | 20859641.1 | 4/2022 |
| KR | 10-2006-0093795 A | 8/2006 |
| KR | 10-1616041 B1 | 4/2016 |
| KR | 10-2019-0003103 A | 1/2019 |
| WO | 2018231218 A1 | 12/2018 |

* cited by examiner

*Primary Examiner* — Rick K Chang

(57) ABSTRACT

An object of the present disclosure is to provide an elbow-shaped duct manufacturing apparatus in which the height of a forming section is easily adjusted as a duct vane forming part has an up and down detachable structure.

8 Claims, 10 Drawing Sheets

ELBOW-SHAPED DUCT MANUFACTURING APPARATUS

BACKGROUND OF THE DISCLOSURE

Technical Field

The present disclosure relates to an elbow-shaped duct manufacturing apparatus, and in particular, to an elbow-shaped duct manufacturing apparatus in which the height of a forming section is easily adjusted by a duct vane forming part having an up and down detachable structure

Background Art

In general, ducts are air passages made with duct connectors for ventilation and circulation of air to protect the respiratory organ of users who use multi-use facilities such as public facilities, residences, and underground shopping malls from indoor pollutants such as fine dust, carbon dioxide, and harmful bacteria, which refers to a portion of air conditioning equipment.

The ducts become complicated and diversified in their structures due to the design considering the convenience and shape of a facility.

With the complicated structures of the facility as described above, the duct manufacturers are manufacturing various ducts such as circular ducts, T-shaped ducts, Y-shaped ducts, and elbow-shaped ducts in consideration of the purpose, use position, and size of the duct.

Among them, in manufacturing elbow-shaped ducts, Patent Document 1, filed on Sep. 22, 2014 by the present applicant, entitled "Apparatus for manufacturing elbow-shaped duct (Korean Patent No. 10-1616041)" discloses an apparatus for manufacturing an elbow-shaped duct.

In Patent Document 1, the apparatus for manufacturing an elbow-shaped duct includes: a main body (100) including a first support (110) obliquely disposed at an upper portion thereof and having a first hollow (111) formed at the center thereof, a second support (120) disposed therein and having a second hollow (121) formed at the center thereof, and an inclined housing tube (130) disposed over the second support (120), having a third hollow (131) formed at the center thereof, and including an inclined member (132) obliquely disposed at an upper portion thereof; a duct movement guiding part (200) disposed at a lower portion of the second support (120) so as to be rotatable and vertically movable and including a duct seating member (210) having a fourth hollow (211) formed at the center thereof; a duct vane forming part (300) disposed at an upper portion of the inclined member (132) and including forming jigs (320 and 320) symmetrically disposed to slide in the opposition directions, respectively, and including semicircular parts (310*a* and 310*b*) having a semi-circular shape and formed on respective facing surfaces; a duct vane coupling part (400) rotatably disposed at an upper portion of the first support (110) and including a duct fixing member (410) guiding fixing of a duct (10) and a duct vane pressing member (420) coupling upper and lower vanes (11 and 11') of the duct (10); and a rotary driving part (500) rotatably disposed inside the main body (100), and including a first driving member (510) obliquely disposed at an upper portion thereof and including an eccentric rotary roller (511) that comprises a cutting roller (511*a*) cutting the duct (10) and a forming roller (511*b*) forming the upper and lower vanes (11 and 11') of the duct (10) and a second driving member (520) disposed at a lower portion thereof and delivering a torque generated by driving of a motor part (not shown) to the first driving member (510), wherein the duct (10) is vertically seated on the duct seating member (210) to allow one side of the duct (10) to be cut into a narrow width and the other side to be cut into a wide width by sequential rising and rotation of the duct movement guiding part (200) and the eccentric rotary roller (511) that is obliquely disposed. In this way, in manufacturing the elbow shaped duct, cutting and forming suitable for the elbow shape can be made at the same time, which may be advantageous in greatly saving the manufacturing time.

However, in the "the apparatus for manufacturing an elbow-shaped duct" of Patent Document 1, the duct vane forming part is formed in one jig shape and thus it may not be possible to adjust the height of a shape forming member.

In addition, in the "apparatus for manufacturing an elbow shape duct" of Patent Document 1, since a forming jig slides by hydraulic pressure, it may not be possible to adjust the stroke distance of the slide, which, in turn, may make it difficult to cope with the shape defect of the vane that may occur depending on the situation.

In addition, in the "apparatus for manufacturing an elbow-shaped duct" of Patent Document 1, when a process for fixing a duct rising while rotating in the diagonal direction is made, a space may be generated between the duct and a duct fixing member contacting the outer peripheral surface of the duct to fix the duct, which may prevent tight fixation of the duct.

In addition, in the "apparatus for manufacturing an elbow-shaped duct" of Patent Document 1, since the outer surface of a forming roller forms a right angle, a lower vane of the cut duct may be pushed to the forming section by the forming roller, which, in turn, may lead to deterioration in workability and deterioration in the finish quality of the bent portion when bending.

(Patent document 1) Korean Patent No. 10-1616041 (Date: Apr. 21, 2016)

SUMMARY

Technical Problem

The present disclosure has been made in consideration of the above problem, and an object of the present disclosure is to provide an elbow-shaped duct manufacturing apparatus in which the height of a forming section is easily adjusted by a duct vane forming part having an up and down detachable structure.

In addition, another object of the present disclosure is to provide an elbow-shaped duct manufacturing apparatus capable of adjusting the stroke distance of slide by a controller by allowing a forming jig to slide by a screw jack such that it can easily cope with forming defect even if the forming defect occurs at a vane due to an error that may occur during a manufacturing process.

In addition, still another object of the present disclosure is to provide an elbow-shaped duct manufacturing apparatus allowing a duct to be tightly fixed when the duct is fixed, by forming a duct fixing member having an angle corresponding to an outer surface of the duct rising while rotating in the diagonal direction.

In addition, still another object of the present disclosure is to provide an elbow-shaped duct manufacturing apparatus capable of increasing workability when coupling to an upper vane of a duct and improving finish quality of a bent portion, by forming a bent angle of a lower vane of the duct in advance when bending the lower vane with the outer surface of a forming roller being formed to be inclined at a predetermined angle.

In order to solve the problems described above, according to various embodiments of the present disclosure, an elbow-shaped duct manufacturing apparatus (1) includes: a main body (100); a duct movement guiding part (200) rotating a duct (10) and moving the duct (10) upward; a duct vane forming part (300) including forming sections (313 and 314) for forming upper and lower vanes (11) and (12) of the duct (10); a rotary driving part (500) including a cutting roller (510) for cutting the duct (10) and a forming roller (520) for pushing the upper and lower vanes (11 and 12) of the duct (10) formed through cutting to the forming sections (313 and 314) and pressing the pushed upper and lower vanes; and a duct vane coupling part (400) coupling the upper and lower vanes (11 and 12) of the duct (10), in which the duct vane forming part (300) includes: first forming jigs (310 and 310') symmetrically disposed to slide in opposite directions and having first semicircular parts (311 and 312) of a semicircular shape formed on inner sides, respectively, the forming sections (313 and 314) being formed on inner surfaces of the first semicircular parts (311 and 312), respectively; and second forming jigs (320 and 320') detachably disposed on the first forming jigs (310 and 310') and having second semicircular parts (321 and 322) of a semicircular shape formed on inner sides, respectively, a diameter of the second semicircular parts being smaller than that of the first semicircular parts (311 and 312), respectively.

In addition, the duct vane forming part (300) may slide through a screw jack (600).

In addition, the duct vane coupling part (400) may include a ring-shaped circular rotating plate (410), a duct vane pressing member (420) coupled to the circular rotating plate (410) to couple the upper and lower vanes (11 and 12) of the duct (10), and a duct fixing member (430) coupled to the circular rotating plate (410) to fix the duct (10), and the duct fixing member (430) may include a pair of right and left fixing units (450 and 440) in a horizontal direction and a pair of upper and lower fixing units (460 and 470) in a vertical direction.

In addition, the left fixing unit (440) may include a first support bracket (441) coupled to the circular rotating plate (410) and a first contact part (442) formed on a tip of the first support bracket (441) to contact an outer peripheral surface of the duct (10), and the first contact part (442) may be formed to be inclined downward from one side to the other side.

In addition, the right fixing unit (450) may include a second support bracket (451) coupled to the circular rotating plate (410) and a second contact part (452) formed on a tip of the second support bracket (451) to contact the outer peripheral surface of the duct (10), and the second contact part (452) may have a symmetrical shape with the first contact part (442).

In addition, the upper fixing unit (460) may include a third support bracket (461) coupled to the circular rotating plate (410) and a third contact part (462) formed on a tip of the third support bracket (461) to contact the outer peripheral surface of the duct (10), and the third contact part (462) may be formed to be inclined downward from a base end to a tip.

In addition, the lower fixing unit (470) may include a fourth support bracket (471) coupled to the circular rotating plate (410) and a fourth contact part (472) formed on a tip of the fourth support bracket (471) to contact the outer peripheral surface of the duct (10), and the fourth contact part (472) may be formed to be inclined upward from a base end to a tip.

In addition, at least one binding reinforcing groove (323) may be provided in a recessed form near edges of the second semicircular parts (321 and 322) such that a stepped section is generated in the upper and lower vanes (11 and 12) of the duct (10) in a process of pressing and coupling the upper and lower vanes (11 and 12) of the duct (10) through the duct vane coupling part (400) in a state in which the upper and lower vanes (11 and 12) of the duct (10) are supported on the second forming jigs (320 and 320').

in addition, the forming roller (520) may include a horizontal pressing part (521) and a lower pressing part (522) under the horizontal pressing part (521), and the outer peripheral surface of the lower pressing part (522) may be formed to be inclined at a predetermined angle in an outward direction from top to bottom.

In addition, a friction protrusion (523) may be formed on the outer peripheral surface of the lower pressing part (522) to increase a frictional force with a surface of the lower vane (12) of the duct (10) in contact with the outer peripheral surface of the lower pressing part (522) in a process of pushing the lower vane (12) of the duct (10) to the forming sections (313 and 314) through the lower pressing part (522) and pressing the pushed lower vane.

Advantageous Effects

As described above, according to an elbow-shaped duct manufacturing apparatus of the present disclosure, since a duct vane forming part has an up and down detachable structure, there is an advantage in that the height of a forming section is easily adjusted.

In addition, since the stroke distance of slide is adjusted by a controller as a forming jig slides by a screw jack, there is an advantage in that, even if the forming defect occurs at a vane due to an error that may occur during a manufacturing process, the forming defect is easily repaired.

In addition, since a duct fixing member is formed to have an angle corresponding to an outer surface of the duct rising while rotating in the diagonal direction, there is an advantage in that the duct is tightly fixed when being fixed.

In addition, since the outer surface of a forming roller is formed to be inclined at a predetermined angle, a bent angle of a lower vane of the duct is formed in advance when bending the lower vane, there is an advantage in that workability when coupling to a duct upper vane is increased and finish quality of a bent portion is improved.

DESCRIPTION OF EXEMPLARY EMBODIMENTS

Figure 1:
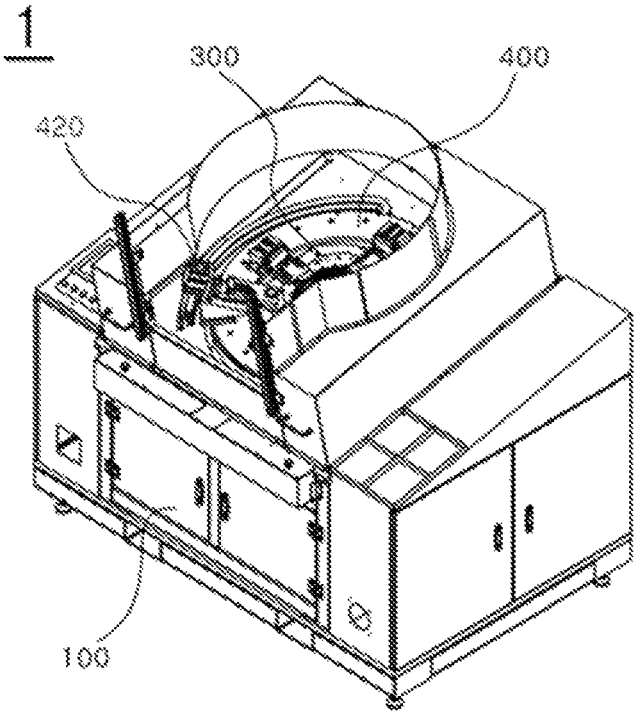
FIG. 1 is a perspective view showing an overall appearance of an elbow-shaped duct manufacturing apparatus according to an embodiment of the present disclosure.
Figure 2:
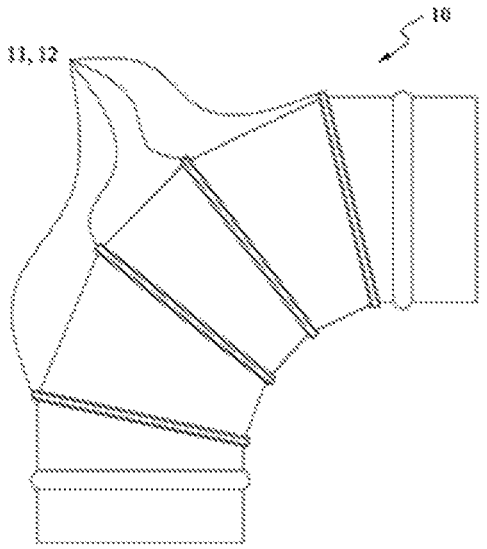
FIG. 2 is a diagram of an elbow-shaped duct manufactured through an elbow-shaped duct manufacturing apparatus according to an embodiment of the present disclosure.
Figure 3:
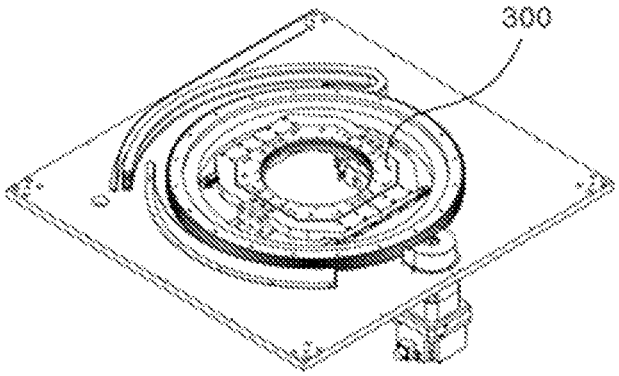
FIG. 3 is a perspective view showing a portion including a duct vane forming part in a configuration of an elbow-shaped duct manufacturing apparatus according to an embodiment of the present disclosure.

Hereinafter, an elbow-shaped duct manufacturing apparatus 1 according to an embodiment of the present disclosure will be described in detail with reference to the accompanying drawings. First, it should be noted that throughout the drawings, the same components or parts are indicated by the same reference numerals as far as possible. In describing the present disclosure, descriptions of well-known functions and constructions may be omitted in order not to obscure the subject matter of the present disclosure.

Referring to FIGS. 1, 3, 7, and 8, the elbow-shaped duct manufacturing apparatus 1 according to an embodiment of the present disclosure largely includes a duct vane forming part 300, a duct vane coupling part 400 and a rotary driving part 500.

Prior to the description, the elbow-shaped duct manufacturing apparatus 1 according to an embodiment of the present disclosure is an improved invention for compensating for the disadvantages of the duct vane forming part 300, the duct fixing member 430, and the forming roller 520 of the components in Patent Document 1, filed on Sep. 22, 2014 by the present applicant, entitled "Apparatus for manufacturing elbow-shaped duct (Korean Patent No. 10-1616041)", and has the similar components except for the improved portions of the duct vane forming part 300, the duct fixing member 430, and the forming roller 520, and thus it should be noted that descriptions of a configuration and coupling relationship with related thereto, and a detailed description of a process of manufacturing the duct 10 will be omitted.

First, the duct vane forming part 300 will be described. As shown in FIG. 1, 3, 4, 5, or 6, the duct vane forming part 300 is a forming frame coupled to the upper side of the main body 100 to form the shape of the upper and lower vanes 11 and 12 of the duct 10, and includes first forming jigs 310 and 310' and second forming jigs 320 and 320'.

The first forming jigs 310 and 310' are disposed symmetrically in the upper and lower directions and slide in opposite directions, and has first semicircular parts 311 and 312 of a semicircular shape formed on inner sides, respectively, such that the duct 10 passes therethrough.

Meanwhile, on the inner surfaces of the first semicircular parts 311 and 312, the forming sections 313 and 314 are formed, respectively, to form the shape of the lower vane 12 of the duct 10.

The second forming jigs 320 and 320' are components that are detachably formed on the first forming jigs 310 and 310', respectively, and that are formed such that the height thereof is adjusted by tightening or loosening a fastening member, such as a bolt, to be fastened, where the height may be fixed by inserting a member to be fixed into a space between the first forming jigs 310 and 310' and the second forming jigs 320 and 320', which is generated by the loosening of the fastening member such as a bolt.

In this way, it is possible to adjust fine parts such as the bending length and height of the vanes in the process of forming the upper and lower vanes 11 and 12 of the duct 10.

Meanwhile, on the inner side of the second forming jigs 320 and 320', the second semicircular parts 321 and 322 of a semicircular shape are formed, respectively, such that the duct 10 passes therethrough.

In this case, it is desirable to form the second semicircular parts 321 and 322 such that the diameter thereof is smaller than that of the first semicircular parts 311 and 312 in order to secure a bending space for allowing the shape of the upper vane 11 of the duct 10 to be formed.

Meanwhile, at least one binding reinforcing groove 323 is provided in a receded form near edges of the second semicircular parts 321 and 322. Through the binding reinforcing groove 323, a stepped section is generated in the upper and lower vanes 11 and 12 of the duct 10 in the process of pressing and coupling the upper and lower vanes 11 and 12 of the duct 10 through the duct vane coupling part 400 in a state in which the upper and lower vanes 11 and 12 of the duct 10 are supported on the second forming jigs 320 and 320', which makes it possible to further increase the binding force of the upper and lower vanes 11 and 12 of the duct 10.

In addition, it is also possible to provide the binding reinforcing groove 323 in a protruding form protruding upward, instead of the recessed groove shape. In this case, it is desirable that the shape of the stepped section is formed symmetrically with the shape of the existing stepped section.

Meanwhile, by sliding through a screw jack 600, the duct vane forming part 300 may adjust the stroke distance compared to the movement through the existing hydraulic method. In this way, the bending error and position error of the product that may occur in the process of forming the upper and lower vanes 11 and 12 of the duct 10 may be corrected, and thus the duct 10 may be manufactured with improved quality.

Figure 4:
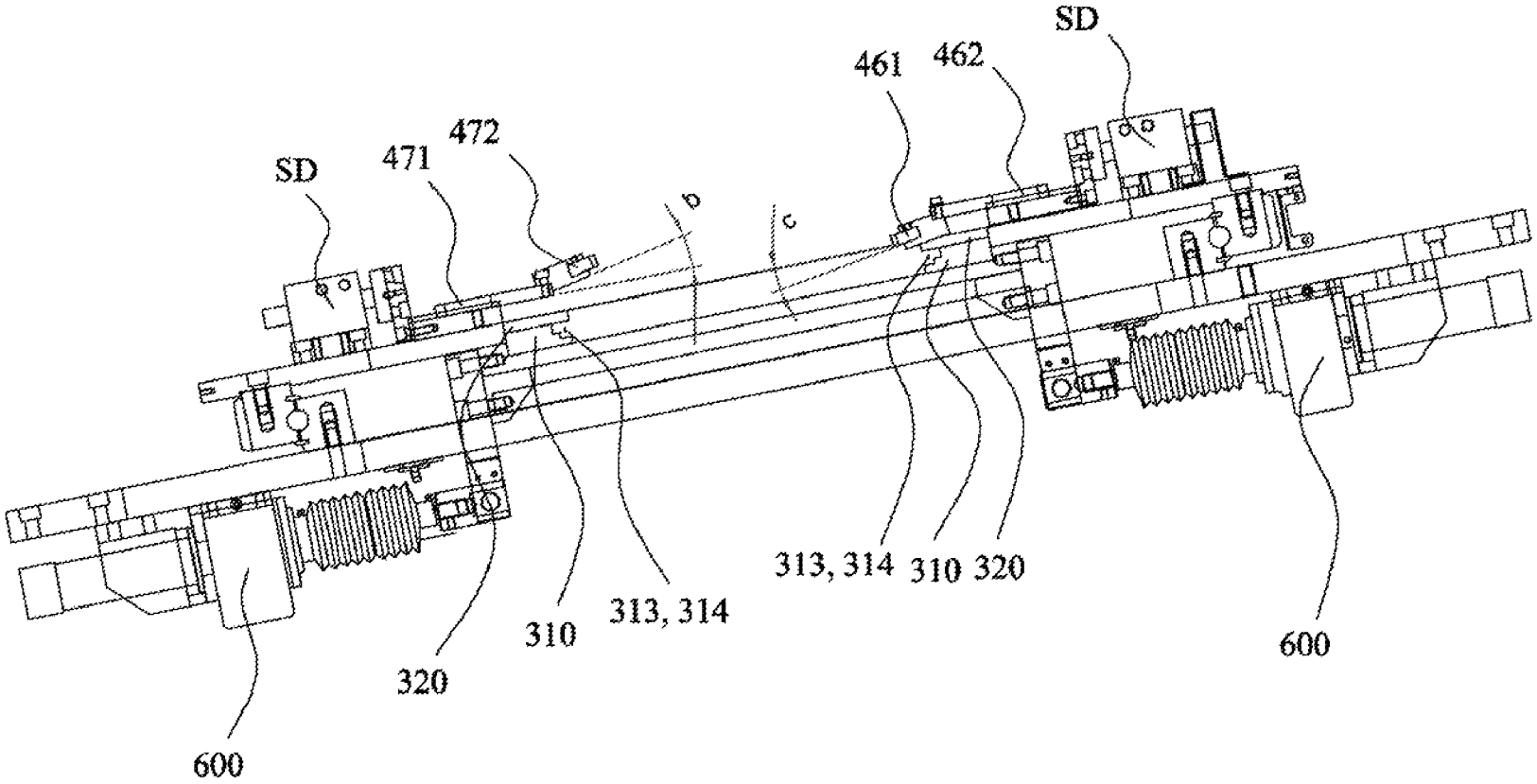
FIG. 4 is a cross-sectional view of a portion around a duct vane forming part in a configuration of an elbow-shaped duct manufacturing apparatus according to an embodiment of the present disclosure.
Figure 5:
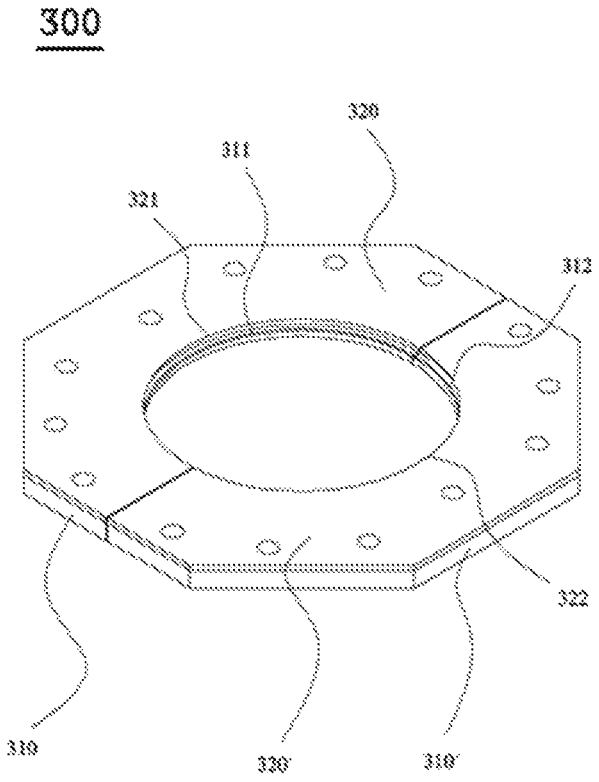
FIG. 5 is a perspective view showing a duct vane forming part in a configuration of an elbow-shaped duct manufacturing apparatus according to an embodiment of the present disclosure.
Figure 6:
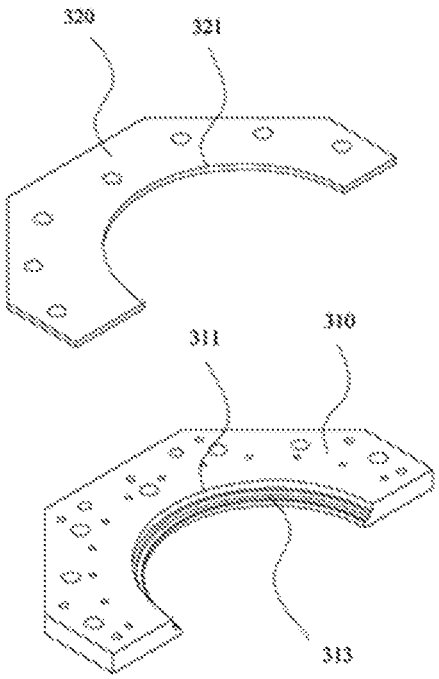
FIG. 6 is an exploded perspective view of a portion of a duct vane forming part in a configuration of an elbow-shaped duct manufacturing apparatus according to an embodiment of the present disclosure.
Figure 7:
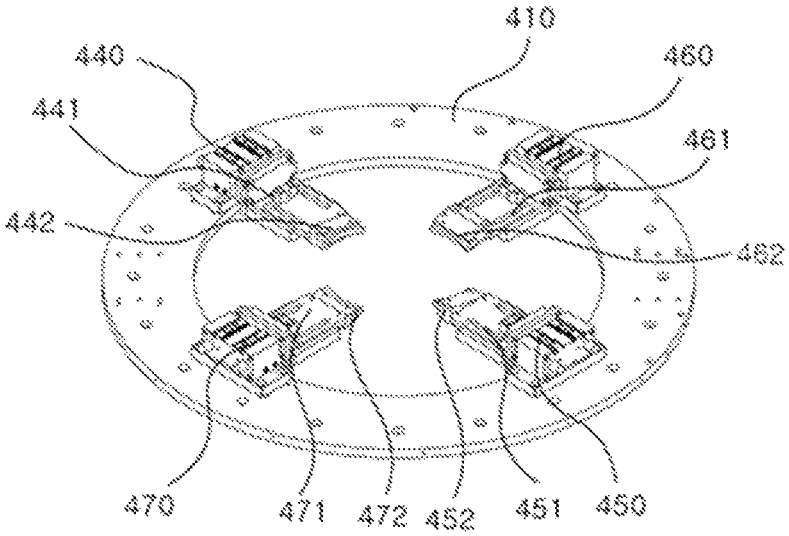
FIG. 7 is a perspective view showing a duct vane coupling part in a configuration of an elbow-shaped duct manufacturing apparatus according to an embodiment of the present disclosure.

Next, the duct vane coupling part 400 will be described. As shown in FIG. 1, 4 or 7, the duct vane coupling part 400 is a component that fixes the duct 10, and couples and integrates the lower and upper vanes 11 and 12 of the duct 10 in the process of forming the upper and lower vanes 11 and 12 of the duct 10, and includes a circular rotating plate 410, a duct vane pressing member 420, and a duct fixing member 430.

The circular rotating plate 410 is a rotating component formed in a ring shape, where the duct vane pressing member 420 and the duct fixing member 430 are coupled, and the duct vane pressing member 420 is a component that moves forward and backward by a cylinder (not shown) so that the upper and lower vane parts 11 and 12 of the duct 10 are coupled.

The duct fixing member 430 is a component that is coupled to the upper side of the circular rotating plate 410 to fix the duct 10 to prevent the duct from shaking or moving in the process of coupling the upper and lower vanes 11 and 12 of the duct 10 by the duct fixing member 430, and includes a pair of right and left fixing units 450 and 440 in the horizontal direction and a pair of up and down fixing units 460 and 470 in the vertical direction.

For the right and left fixing members 450 and 440 and the up and down fixing units 460 and 470, angles of parts for holding the duct 10, that is, first, second, third, and fourth contact parts 442, 452, 462, and 472, which will be described later, are most important in order to tightly hold the duct 10 that is being manufactured in the diagonal direction even while the duct fixing member 430 is also rotated by the rotation of the circular rotating plate 410.

First, the left fixing unit 440 includes a first support bracket 441 coupled to the circular rotating plate 410 and a first contact part 442 formed on a tip of the first support bracket 441 to contact an outer peripheral surface of the duct 10, and the first contact part 442 is formed to be inclined downward from one side to the other side.

In addition, the right fixing unit 450 includes a second support bracket 451 coupled to the circular rotating plate 410 and a second contact part 452 formed on a tip of the second support bracket 451 to contact the outer peripheral surface of the duct 10, and the second contact part 452 has a shape symmetrical with the first contact part 442.

That is, it is desirable that the first contact part 442 and the second contact part 452 are formed at the same angle in a state of facing each other, and in the process of vertically rising the duct 10 on a plane, are formed in a horizontal state parallel to the vertical plane.

The upper fixing unit 460 includes a third support bracket 461 coupled to the circular rotating plate 410 and a third contact part 462 formed on a tip of the third support bracket 461 to contact the outer peripheral surface of the duct 10, and the third contact part 462 is formed to be inclined downward (c) from a base end to a tip.

In addition, the lower fixing unit 470 includes a fourth support bracket 471 coupled to the circular rotating plate 410 and a fourth contact part 472 formed on a tip of the fourth support bracket 471 to contact the outer peripheral surface of the duct 10, and the fourth contact part 472 is formed to be inclined upward (b) from a base end to a tip.

That is, it is desirable that the third contact part 462 and the fourth contact part 472 are formed at opposite angles in a facing state, and the inclined angle is formed to be the same as the upper and lower angles of the duct 10 to be manufactured.

Meanwhile, each of the first, second, third, and fourth contact parts 442, 452, 462, and 472 may be moved forward and backward by each cylinder SD, and may be formed of silicon material, which makes it possible to prevent the occurrence of scratches or the like on the surface of the duct 10 due to rotation, contact, or the like.

Figure 8:
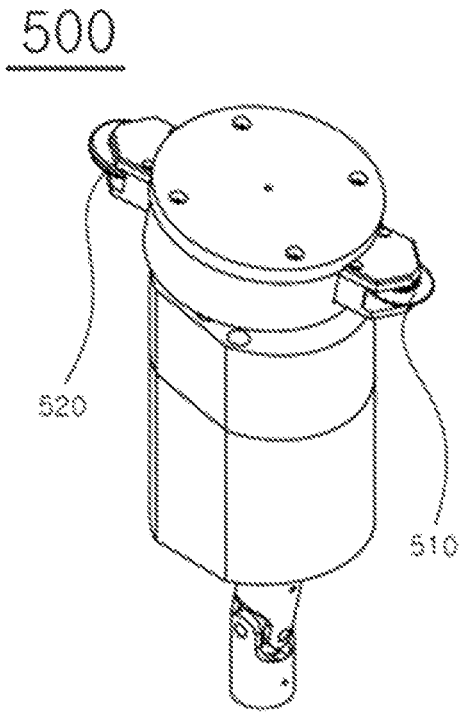
FIG. 8 is a perspective view showing a rotary driving part in a configuration of an elbow-shaped duct manufacturing apparatus according to an embodiment of the present disclosure.
Figure 9:
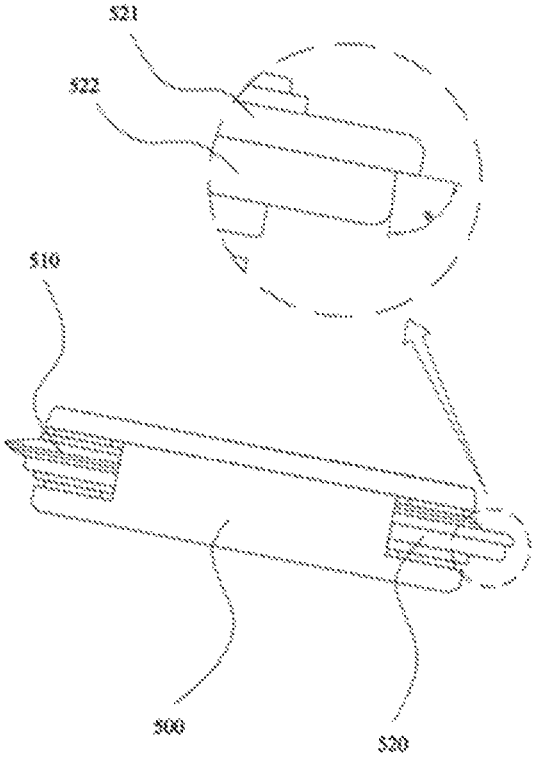
FIGS. 9 and 10 are front views showing a cutting roller and a forming roller of a rotary driving part in a configuration of an elbow-shaped duct manufacturing apparatus according to an embodiment of the present disclosure.
Figure 10:
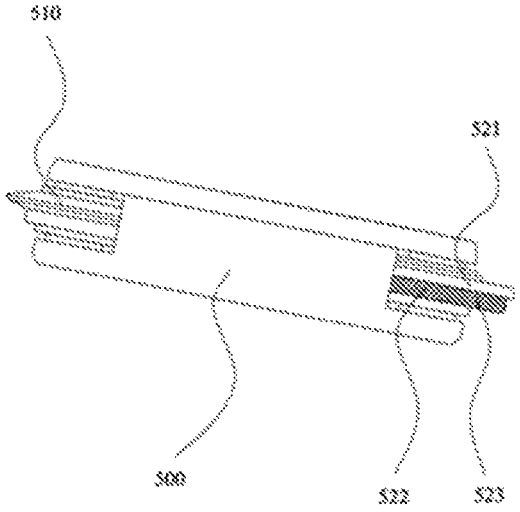
Figure 11:
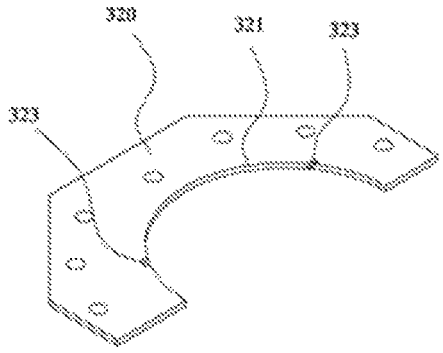
FIG. 11 is a perspective view showing a portion of a second forming jig in a configuration of an elbow-shaped duct manufacturing apparatus according to another embodiment of the present disclosure.
Figure 12:
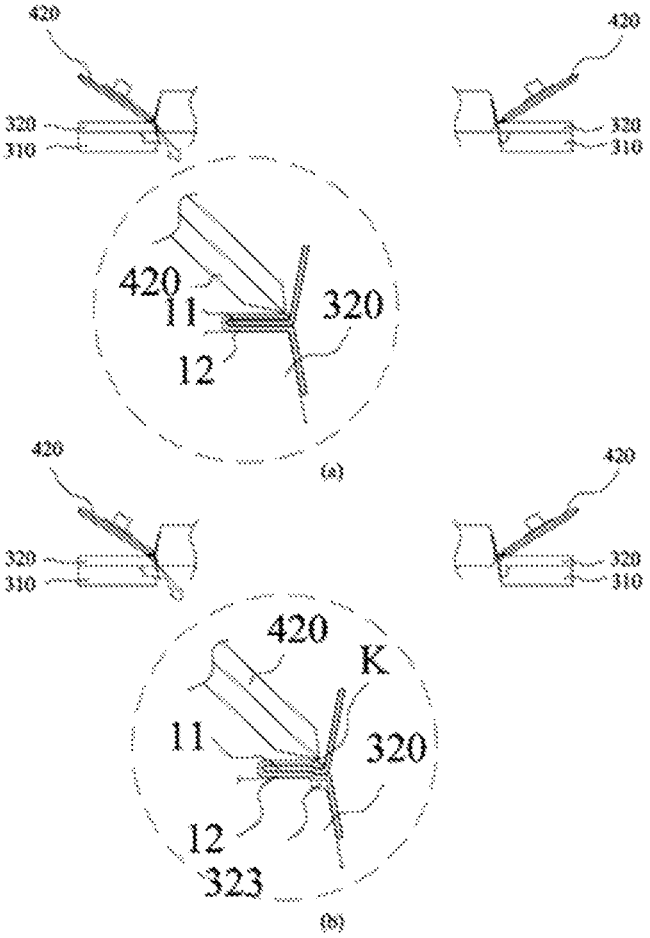
FIG. 12 is a schematic view showing a process in which upper and lower vanes of the duct are coupled through an elbow-shaped duct manufacturing apparatus according to an embodiment of the present disclosure.

Next, the rotary driving part 500 will be described. As shown in FIG. 8, 9, or 10, the rotary driving part 500 is a component that cuts the duct 10, and forms the upper and lower vanes 11 and 12 of the duct 10 in connection with the duct vane forming part 300, and includes the cutting roller 510 and the forming roller 520.

The cutting roller 510 is a kind of blade for cutting the duct 10 by rotational force.

The forming roller 520 is a component that is formed on the opposite side of the cutting roller 510 and pushes the upper and lower vanes 11 and 12, which are the cut portions of the duct 10, to the forming sections 313 and 314 and presses the pushed vanes, and includes a horizontal pressing part 521 at an upper portion, and a lower pressing part 522 under the horizontal pressing part 521.

Meanwhile, with the outer peripheral surface of the lower pressing part 522 being formed to be inclined at a predetermined angle (a) outward from the top to the bottom, the bent angle is formed in advance when bending the lower vane 12 of the duct 10, which makes it possible to facilitate the coupling with the upper vane 11 of the duct 10 and to improve the finish quality of the bent portion.

In addition, a friction protrusion 523 is further formed on the outer peripheral surface of the lower pressing part 522 to increase a frictional force with a surface of the lower vane 12 of the duct 10 in contact with the outer peripheral surface of the lower pressing part 522 in the process of pushing the lower vane 12 of the duct 10 to the forming sections 313 and 314 through the lower pressing part 522 and pressing the pushed lower vane. In this way, sliding is prevented, and thus smooth pressing may be achieved.

As described above, optimal embodiments have been disclosed in the drawings and the specification. Although specific terms have been used herein, these are only intended to describe the present disclosure and are not intended to limit the meanings of the terms or to restrict the scope of the present disclosure as disclosed in the accompanying claims. Therefore, those skilled in the art will appreciate that various modifications and other equivalent embodiments are possible from the above embodiments. Therefore, the scope of the present disclosure should be defined by the technical spirit of the accompanying claims.

What is claimed is:

1. An elbow-shaped duct manufacturing apparatus (1), comprising:

a main body (100);

a duct movement guiding part (200) rotating a duct (10) and moving the duct (10) upward;

a duct vane forming part (300) including forming sections (313, 314) for forming upper and lower vanes (11, 12) of the duct (10);

a rotary driving part (500) including a cutting roller (510) for cutting the duct (10) and a forming roller (520) for pushing the upper and lower vanes (11, 12) of the duct (10) formed through cutting to the forming sections (313,314) and pressing the pushed upper and lower vanes; and a duct vane coupling part (400) coupling the upper and lower vanes (11, 12) of the duct (10), wherein the duct vane forming part (300) includes:

first forming jigs (310, 310') symmetrically disposed to slide in opposite directions and having first semicircular parts (311, 312) of a semicircular shape formed on inner sides, respectively, the forming sections (313, 314) being formed on inner surfaces of the first semicircular parts (311, 312), respectively; and second forming jigs (320, 320') detachably disposed on the first forming jigs (310, 310') and having second semicircular parts (321, 322) of a semicircular shape formed on inner sides, respectively, a diameter of the second semicircular parts being smaller than that of the first semicircular parts (311, 312), respectively.

2. The elbow-shaped duct manufacturing apparatus (1) of claim 1, wherein the duct vane forming part (300) slides through a screw jack (600).

3. The elbow-shaped duct manufacturing apparatus (1) of claim 1, wherein the duct vane coupling part (400) includes:

a ring-shaped circular rotating plate (410);

a duct vane pressing member (420) coupled to the circular rotating plate (410) to couple the upper and lower vanes (11, 12) of the duct (10); and a duct fixing member (430) coupled to the circular rotating plate (410) to fix the duct (10), and the duct fixing member (430) includes a pair of right and left fixing units (450, 440) in a horizontal direction and a pair of upper and lower fixing units (460, 470) in a vertical direction.

4. The elbow-shaped duct manufacturing apparatus (1) of claim 3, wherein the left fixing unit (440) includes:

a first support bracket (441) coupled to the circular rotating plate (410); and a first contact part (442) formed on a tip of the first support bracket (441) to contact an outer peripheral surface of the duct (10), and the first contact part (442) is formed to be inclined downward from one side to the other side.

5. The elbow-shaped duct manufacturing apparatus (1) of claim 4, wherein the right fixing unit (450) includes:

a second support bracket (451) coupled to the circular rotating plate (410); and a second contact part (452) formed on a tip of the second support bracket (451) to contact the outer peripheral surface of the duct (10), and the second contact part (452) has a symmetrical shape with the first contact part (442).

6. The elbow-shaped duct manufacturing apparatus (1) of claim 3, wherein the upper fixing unit (460) includes:

a third support bracket (461) coupled to the circular rotating plate (410); and a third contact part (462) formed on a tip of the third support bracket (461) to contact the outer peripheral surface of the duct (10), and the third contact part (462) is formed to be inclined downward from a base end to a tip.

7. The elbow-shaped duct manufacturing apparatus (1) of claim 3, wherein the lower fixing unit (470) includes:

a fourth support bracket (471) coupled to the circular rotating plate (410); and a fourth contact part (472) formed on a tip of the fourth support bracket (471) to contact the outer peripheral surface of the duct (10), and the fourth contact part (472) is formed to be inclined upward from a base end to a tip.

8. The elbow-shaped duct manufacturing apparatus (1) of claim 1, wherein the forming roller (520) includes:

a horizontal pressing part (521) and a lower pressing part (522) under the horizontal pressing part (521), and the outer peripheral surface of the lower pressing part (522) is formed to be inclined at a predetermined angle in an outward direction from top to bottom.

* * * * *